US011499324B2

(12) United States Patent
Schindler

(10) Patent No.: US 11,499,324 B2
(45) Date of Patent: Nov. 15, 2022

(54) PROFILE SYSTEM FOR A SANITARY FACILITY

(71) Applicant: COMBIA GMBH, Munich (DE)

(72) Inventor: Martin Schindler, Munich (DE)

(73) Assignee: Combia GmbH, Munich (DE)

( * ) Notice: Subject to any disclaimer, the term of this patent is extended or adjusted under 35 U.S.C. 154(b) by 0 days.

(21) Appl. No.: 16/377,733

(22) Filed: Apr. 8, 2019

(65) Prior Publication Data

US 2019/0309530 A1 Oct. 10, 2019

(30) Foreign Application Priority Data

Apr. 9, 2018 (EP) ..... 18166342

(51) Int. Cl.

| | |
|---|---|
| ***E04F 19/06*** | (2006.01) |
| ***E03F 5/04*** | (2006.01) |
| ***A47K 3/36*** | (2006.01) |
| ***A47K 3/30*** | (2006.01) |
| *A47K 3/16* | (2006.01) |
| *A47K 3/00* | (2006.01) |
| *A47K 3/40* | (2006.01) |

(52) U.S. Cl.

CPC ..... *E04F 19/062* (2013.01); *A47K 3/30* (2013.01); *A47K 3/36* (2013.01); *E03F 5/0408* (2013.01); *E04F 19/061* (2013.01); *A47K 3/008* (2013.01); *A47K 3/16* (2013.01); *A47K 3/405* (2013.01); *E03F 5/0409* (2013.01); *E04F 19/065* (2013.01)

(58) Field of Classification Search

CPC ..... E04F 19/062; E04F 19/061; E04F 19/065; E03F 5/0408; E03F 5/0409; A47K 3/36; A47K 3/30; A47K 3/008; A47K 3/405; A47K 3/16; A47K 3/004; A47K 3/40; A47K 3/283; A47K 3/284

USPC ..... 52/169.5, 302.1, 302.2, 302.6; 4/612–614

See application file for complete search history.

(56) References Cited

U.S. PATENT DOCUMENTS 2,705,542 A * 4/1955 Yavitch ..... E03F 5/0408 138/90
4,092,745 A * 6/1978 Oropallo ..... E03F 5/0408 4/292

(Continued)

FOREIGN PATENT DOCUMENTS

CN 101827549 A 9/2010
DE 202005020345 U1 2/2006

(Continued)

OTHER PUBLICATIONS

European Patent Office, Search Report in corresponding EP18166342, dated Jan. 21, 2019, 15 pages.

(Continued)

*Primary Examiner* — Brian E Glessner
*Assistant Examiner* — Adam G Barlow
(74) *Attorney, Agent, or Firm* — Hooker & Habib, P.C.

(57) ABSTRACT

A profile system for a sanitary system, such as a floor-level shower, includes at least one profile element and at least one flat and flexible sealing element. The sealing element has a mounting area which, in a non-installed state, is fixed to the profile element by a mounting element. The sealing element includes at least one region overlapping the profile element, the overlapping region being adapted to fix the profile element in its mounting position.

31 Claims, 16 Drawing Sheets

(56) References Cited

U.S. PATENT DOCUMENTS

| | | | | | |
|---|---|---|---|---|---|
| 4,332,393 | A * | 6/1982 | Cuschera | F16L 41/088 | 277/621 |
| 4,943,100 | A * | 7/1990 | Emberson | E03F 5/0409 | 210/164 |
| 5,243,799 | A * | 9/1993 | Schluter | E04F 15/02027 | 52/282.1 |
| 5,535,556 | A * | 7/1996 | Hughes, Jr. | E04B 1/7023 | 52/293.3 |
| 5,630,235 | A * | 5/1997 | Angstadt | A47K 3/001 | 4/583 |
| 5,850,716 | A * | 12/1998 | Thompson | E04F 19/065 | 52/459 |
| 5,950,370 | A * | 9/1999 | Peck | A47K 3/008 | 4/584 |
| 6,293,064 | B1 * | 9/2001 | Larson | E04F 13/068 | 52/302.1 |
| 6,401,418 | B1 * | 6/2002 | Senn | E04F 19/04 | 52/287.1 |
| 7,313,891 | B2 * | 1/2008 | Showers | E04B 1/7069 | 52/270 |
| 8,640,390 | B2 * | 2/2014 | Schlueter | E04F 15/02005 | 52/287.1 |
| 9,687,118 | B2 | 6/2017 | Schindler | | |
| 10,314,441 | B2 * | 6/2019 | Kratzmann | E04F 19/061 | |
| 2007/0056088 | A1 * | 3/2007 | DeGooyer | E03F 5/0409 | 4/613 |
| 2007/0193201 | A1 * | 8/2007 | Cowling | A47K 3/40 | 52/846 |
| 2010/0263188 | A1 * | 10/2010 | Cook | A47K 3/40 | 29/428 |
| 2011/0067175 | A1 * | 3/2011 | Steylaerts | E03F 5/0408 | 4/679 |
| 2012/0037552 | A1 * | 2/2012 | Persson | E03F 5/0408 | 210/163 |
| 2015/0033656 | A1 * | 2/2015 | Geels | E04C 2/46 | 52/506.01 |
| 2016/0262576 | A1 * | 9/2016 | Kratzmann | A47K 3/40 | |
| 2017/0280943 | A1 | 10/2017 | Schindler | | |
| 2018/0340319 | A1 * | 11/2018 | Schlüter | E03C 1/14 | |

FOREIGN PATENT DOCUMENTS

| | | | | |
|---|---|---|---|---|
| DE | 102007058299 | A1 | | 7/2009 |
| DE | 102010016816 | A1 | | 2/2010 |
| DE | 202009017155 | U1 | | 4/2010 |
| DE | 202009017155 | | * | 5/2010 |
| DE | 202009015093 | U1 | | 12/2010 |
| DE | 102012107269 | A1 | | 5/2013 |
| DE | 202014004016 | U1 | | 8/2014 |
| DE | 102014100783 | A1 | | 7/2015 |
| DE | 102011050825 | A1 | | 8/2015 |
| DE | 102006007471 | B4 | | 8/2017 |
| EP | 2905389 | | * | 8/2015 |
| EP | 2905389 | A1 | | 8/2015 |
| EP | 2184415 | B1 | | 1/2016 |
| WO | 2017070721 | A1 | | 5/2017 |

OTHER PUBLICATIONS

European Patent Office, Examination Report in corresponding EP18166432, dated Apr. 8, 2021, 5 pages.

China National Intellectual Property Administration, Examination Report in corresponding CN2019102783329, dated Nov. 4, 2021, 4 pages.

https://translate.yandex.com/, English language machine translation of Examination Report in corresponding CN2018102783329, downloaded Jul. 7, 2022.

WIPO Translate, English machine translation of specification of DE102007058299A1, obtained Jun. 8, 2022, 7 pages.

* cited by examiner

PROFILE SYSTEM FOR A SANITARY FACILITY

RELATED APPLICATION

This application claims priority to and the benefit of the filing date of European Patent Office application EP18166342 titled "Profilsystem für eine sanitäre Anlage" filed Apr. 9, 2019.

FIELD OF THE DISCLOSURE

The disclosure concerns a profile system consisting of at least one profile element and at least one sealing element for a sanitary system, such as a floor-level shower.

BACKGROUND OF THE DISCLOSURE

In general, profile systems for sanitary facilities are known in different designs and can be designed for different tasks. For example, profile systems may be designed for use as shower channel assemblies. Furthermore, profile systems for the fixed storage of panes, such as a shower wall, are used in the area of wet cells. In addition, profiles for mounting wall facing panels or decorative profiles, such as a slope wedge for sanitary installations, are also used.

Profile systems for sanitary facilities must be installed in such a way that they are watertight.

DE 10 2006 007 471 B4 shows a shower floor element made of hard foam for a floor-level shower. The shower base element has a foil foamed on at least the upper side, which in turn can have a fabric. The film serves as an adhesive layer on which a shower floor covering can be applied directly. The film can also cover a channel profile molded into the shower floor element, into which a drain frame is inserted.

EP 2 184 415 B1 incorporated by reference as if fully set forth herein shows a floor-level drain device for installation in a shower or wet cell. The device consists of a drainage channel with a longitudinal collar, with a sliding frame arranged under the longitudinal collar. In the area of the longitudinal collar there is a flexible sealing strip which is attached to a vertical surface of the frame.

DE 10 2012 107 269 A1 incorporated by reference as if fully set forth herein shows a mounting kit for achieving a sealing effect between a fixed device (e.g. a bathtub) and a vertical wall section. The mounting kit includes a connecting strip with a wall end strip arranged on the wall side. Furthermore, an insulation strip is connected to the wall end strip and the device in the assembled state by means of an adhesive connection.

DE 10 2010 016 816 A1 incorporated by reference as if fully set forth herein shows a sealing system for floor channel drains as used in showers. The sealing system includes a sealing strip that can be glued to the edge of a channel.

It is therefore well known to seal profile systems by attaching a profile, such as a drain channel, to a sealing strip or the like during assembly. The known measures for sealing profile systems, however, are cumbersome and inflexible to handle, as several steps are required, including the application of a sealing material at the installation site and the installation of the profile. Furthermore, the known systems require complex structural designs in order to be able to fasten the profile reliably. Finally, it is difficult or even impossible to adapt the profile to the surrounding wall and/or floor coverings in sanitary facilities.

SUMMARY OF THE DISCLOSURE

With this in mind, disclosed is a profile system that at least partially overcomes the above-stated disadvantages.

Disclosed is a profile system for a sanitary installation, such as a floor-level shower, that, in an embodiment, includes at least one profile element and at least one flat and flexible sealing element for sealing between the profile element and a wall and/or floor region adjacent to the profile element. The sealing element has a mounting area which, in a non-installed state, is fixed to the profile element by a fixing means. The sealing element has at least one region overlapping the profile element, the overlapping region being configured to fix the profile element in its mounting position.

Accordingly, the profile system includes at least one profile element. The profile element can have a prefabricated raw material shape that has a basic geometric shape. The profile element can be an elongated workpiece, i.e. the length of the profile element is many times greater than the height or depth. Furthermore, the profile element can have any shape suitable for supporting or holding an object. The profile element may also have a shape suitable for conducting or carrying liquids. The profile element may have a U-shaped, L-shaped or other symmetrical or asymmetrical shape in its cross-section. The profile element may also have a corner profile or a curved profile. The profile system may also include a variety of profile elements. These can be arranged in a straight line, in a curve or over a corner. The profile element can be an extrusion or extruded profile.

The profile element can be made of any material suitable for forming a specific profile shape. The profile element can be a metal profile, such as stainless steel, and is preferably made of aluminum, as aluminum is lightweight, easy to shape and has sufficient dimensional stability. The profile element can be partially made of aluminum or an aluminum alloy. However, any other material with good formability and low weight can also be used. An extrusion or extruded plastic profile can also be used as a profile element.

In addition to at least one profile element, the profile system in embodiments may also include at least one flat and flexible sealing element for sealing between the profile element and a wall and/or floor area adjacent to the profile element. The sealing element can be a foil, a tape, a membrane or other flat design. The sealing element can be rectangular, round or any other flat shape. The sealing element can be a waterproof sealing foil, which can consist of different plastics. The sealing element may contain rubber-like material such as rubber or silicone. The sealing element can also be made of a soft plastic. The sealing element can be made of any material that is impermeable to water and therefore suitable for sealing. The sealing element can be made of any material that has a sealing effect and at the same time a tensile strength sufficient to safely support the weight of a profile element. The sealing element may include a variety of sealing foil pieces. The sealing element may have a non-woven coating for better adhesion of other sealants or adhesives. The sealant may be a polyethylene film with polypropylene fleece on top.

The sealing element of the profile system in possible embodiments is not only suitable for sealing between the profile element and an adjacent wall and/or floor area. The sealing element can also be designed to seal any areas under, next to and/or above a profile element.

The sealing element of the profile system in possible embodiments also has a mounting area which is fastened to the profile element by a fastener in a non-installed state. The mounting area corresponds to a partial surface of the sealing element which is connected to a surface of at least one profile element. In possible embodiments, the mounting area is connected flatly to the profile element, i.e. the partial surface is, essentially, completely fastened to the profile element. The mounting area can be a continuous surface, but it can also include a large number of partial surfaces of the sealing element. When a variety of sealing elements are used, each of the variety of sealing elements may have a fastening area. The mounting area may be rectangular, round or any other suitable shape. From the point of view of the profile element, the mounting area is the area that is in planar contact with the sealing element.

The non-installed condition is a condition in which the profile system is in a delivery arrangement at the factory, i.e. the sealing element is already attached to the profile element, but it is neither in a sealing condition nor in an installation location such as a wall and/or floor area. The sealing element is therefore only connected to the profile element via the fastening surface in the non-installed state. The remaining unmounted area of the sealing element can therefore be loose.

The sealing element is attached to the disclosed profile element. This is done in possible embodiments using a fastener. The fastener can be a variety of different fasteners. The fastener may include an adhesive, screw and/or other means suitable for attaching the fastening surface to the profile element. A sealant may also be injected. The sealant is, preferably, bonded to the profile element. The profile element can also have an adhesive layer to which the sealant is bonded. The mounting area is then defined by the points where the sealant is bonded to the profile element. The sealant can also be glued and additionally screwed in. It is advantageous that the mounting area is so large that even in the vertical position of the sealant, the profile element cannot detach from the mounting area without external influence. At the same time, the mounting area is advantageously designed to be at least large enough to reliably seal an area to be sealed adjacent to the profile element (e.g. an underlying joint).

In accordance with the disclosure, the sealing element in embodiments may have at least one region overlapping the profile element, the overlapping region being designed to fix the profile element in its installation position. The area of the sealing element may be smaller than the area of the profile element opposite the sealing element and at the same time have an overlap area. The overlap area can partially overlap the profile element, i.e. the sealing element only partially overlaps the surface of the profile element opposite the sealing element. The overlap area can project completely over the edge of a surface of the profile element to be mounted. The overlap area can overlap the profile element at various points. It is advantageous if the overlap area corresponds to an area that is large enough to be able to fasten the profile element reliably to a wall or floor without the need for additional mounting devices. When not installed, the flat overlap area is flexible, loose or movable.

Advantageously, the disclosed profile system in possible embodiments has, in addition to a sealed mounting area, overlapping areas which serve for the flexible mounting of the profile element to the wall or floor as well. Furthermore, the mounting area can be smaller than the area of the profile element opposite the mounting area. This means that parts of the sealant are neither fastened nor overlap the profile element. It is therefore advantageous to cut the profile element to the required length.

The disclosed profile system in embodiments allows not only the reliable mounting of a profile element to or in a wall or on a floor, but also a variable adjustment of the height of the profile element during assembly. In addition, size adjustment (e.g. cutting to length) of the profile system can be carried out very easily depending on the structural conditions. At the same time, a high sealing effect is ensured by the use of a sealing agent such as a sealing foil.

The disclosed profile system in embodiments may be primarily intended for a sanitary installation, like a floor-level shower, but it should in no way be limited to this application. Thus the disclosed profile system is intended for any application in which profiles with sealing gaskets are used.

In possible embodiments, the installation position of the profile element can be variably adjusted in the vertical and/or horizontal direction by means of the overlapping area. The installation position is understood to be the position in which the profile element is loosely arranged on a floor, wall and/or ceiling surface, i.e. in which the profile system is not yet fixated. It is advantageous that the overlap area is at least so large that this area is sufficient to keep the profile element stable in a certain position when installed.

In possible embodiments, the overlap area extends to at least two opposite sides of the mounting area in the form of two partial overlap areas which are provided for mounting the profile element to at least one wall, ceiling and/or floor surface and/or a respective covering connected thereto. The two partial overlap areas act as fixation devices, i.e. when the profile system is in the installation position, the partial overlap areas are slightly fixed to a wall, ceiling and/or floor surface by means of tiles and/or tile adhesive to keep the profile element fixed to the mounting area stable. Accordingly, the partial overlap areas are sufficiently dimensioned to hold the weight of the profile element securely, i.e. tilting or twisting of the profile element is not possible.

In possible embodiments, the profile element and/or the sealing element can be cut to size. When not installed, the profile element can only be partially covered in its longitudinal direction by the sealing element. The profile element may have an end section to which the sealing element is not attached. The profile element may also have both end sections without a sealant attached to them. The profile element can be individually shortened according to the client's wishes using a saw or other cutting tool in the section area where there is no glued sealing foil. In this way, the profile element can be optimally adapted to a tile or floor slab format or a joint grid in the area of sanitary facilities. The profile element is preferably not covered with the sealing element at its longitudinal ends. The advantage is that the profile element can therefore be cut to size at both ends. This allows an individual adaptation of the profile element length to the structural conditions at the installation site.

The profile element which can be cut to size can also have at least one profile end piece which can be detachably connected to an open end of the profile element. The profile element may have two open ends, each of which is hermetically sealed by a profile end piece. The profile end pieces or end caps are preferably used after the profile element has been cut to the installation length.

In possible embodiments, the profile element is intended as a collector profile for shower water, to be installed in or attached to a wall. The disclosed profile is not limited to this application. The collector profile can also include a drain channel or a channel body. The collector profile can be fully or partially integrated into a wall. The collection profile can also be integrated into the floor in front of a wall. The profile system consisting of collecting profile and sealing element can be placed anywhere in a shower cubicle where water, which is to be led to a drain, accumulates.

In possible embodiments, the profile element has at least one inlet opening for letting shower water into the collection profile. The inlet opening can be located laterally. The inlet opening can preferably extend over the entire length of the collection profile. Several inlet openings may also be used. The inlet opening may be provided with a cover designed to allow water to continue to pass, but to prevent small parts or body parts from entering the collection profile.

In possible embodiments, the profile element has at least one outlet opening for discharging shower water into a siphon. The outlet opening corresponds to a drain. The outlet opening can be installed in the collection opening in such a way that it is easy to reach for cleaning by means of a shower jet. The outlet opening is preferably located in the floor, i.e. in a lower surface of the collection profile. The outlet opening can be installed in such a way that surfaces inclined towards the outlet opening are arranged on it in order to improve the water drainage. There may also be several outlet openings.

In possible embodiments, the profile element has at least one inlet opening and one outlet opening. Preferably the inlet opening in the mounting position is located at a higher level than the outlet opening to improve water drainage.

In possible embodiments, the collection profile is U-shaped with a base, a back wall and an upper base. The collection profile can also have a different cross-section profile design (e.g. a C-profile or L-profile). The collection profile can also have one collection profile end piece at each of its longitudinal ends for lateral sealing. The collection profile can therefore be closed apart from the inlet opening and the outlet opening.

In possible embodiments, the inlet opening is provided on the side facing away from the back wall. Accordingly, the opening can be opposite the back wall, i.e. it can be a lateral inlet opening. The opening can extend over the entire height of the U-shaped profile. The opening may be reduced by a further leg which, starting from the end of the bottom, extends perpendicularly to the back wall over a height which is less than the total height of the U-shaped profile. This additional leg can extend to a height which, in the installation position of the profile system, corresponds to a floor covering level so as to ensure water intake into the inlet opening.

In possible embodiments, the outlet opening is located in the bottom. The outlet opening can be a round opening with an angular or other suitable shape that allows the water in the collection profile to be drained into a siphon or the like.

In possible embodiments, the collection profile is U-shaped with a base, a back wall and an upper base, the opening is provided on the side facing away from the back wall and the outlet opening is formed in the base.

In possible embodiments, the profile system may extend along the floor in the direction of the side facing away from the back wall with an inwardly inclined inlet slope. The inlet slope and the collection profile can be formed in one piece. The inlet slope and the collection profile can be connected detachably. The inlet slope can be made of the same material as the collection profile. The inlet slope can have a slope that points in the direction of the outlet opening. At its highest point, the inlet slope must not exceed the surface level of the shower base when installed. The inlet slope can also be designed without a slope, i.e. horizontally in the installed state.

In possible embodiments, the inlet slope has at least one drainage channel. At least one drainage channel extends through the inlet slope with a slope towards the outlet opening. The drainage channel is designed to direct water to the drain which, when installed, collects between the front face of the inlet slope and the floor covering. Preferably, the inlet slope has a large number of drainage channels.

In possible embodiments, the mounting area is connected to the back wall and the bottom of the collector profile over an area, whereby the mounting area partially covers the back wall and the bottom. This means that a part of the sealing element extending from the mounting area is not connected to the bottom and back wall of the profile element. The mounting area is preferably arranged in such a way that the profile element has end sections to which the sealing element is not connected. At these end sections, the profile element can conveniently be cut to size.

In possible embodiments, the inlet opening of the collection profile is designed in such a way that, in the installation position, a gap is formed between a wall covering, in particular tiles, and a floor covering, in particular tiles, as a water drain. Preferably, the gap has a height that is large enough that the collection profile can be cleaned with the shower head shower in assembled condition. The gap is preferably designed in such a way that no small parts or body parts such as toes can get in.

A siphon can be equipped with the disclosed profile system. The siphon can be a drainage system through which waste water or shower water can pass. The siphon can be connected to the profile at the factory. Preferably, a foil is firmly connected between the siphon and the profile. The siphon is preferably a flow-optimized, self-cleaning siphon. The advantage of using a self-cleaning siphon is that the inlet opening of the profile system can be very narrow.

A shower element can be equipped with the disclosed profile system.

In possible embodiments, the profile element is designed as an ornamental strip for a shower with a floor slope. The trim strip can also be designed as a slope wedge. The trim can be designed to visually enhance the height difference of floor tiles. The difference in height can be one step. It can also be a difference in height caused by a slope of a floor-level shower compared to the floor next to the shower. The trim strip and the slope wedge can be shaped as a flat elongated profile. During installation, the overlapping area of the sealing element can be placed on the higher floor area and on the lower floor area. The trim strip or the slope wedge is arranged parallel to the step, with the upper end essentially flush with the surface of the upper floor tile. The lower floor tile is then placed on the overlap area and installed or fixed.

In possible embodiments, the mounting area extends to a lower section of a trim side surface. The advantage of this is that, despite the difference in height, the trim strip or the slope wedge is stable and can be easily fixed by the overlap area.

In possible embodiments, the profile element is provided as an L-profile. Preferably the L-profile has a right angle in the cross section. However, the L-profile can also have other angles. The L-profile can be used as a support profile or as an end profile. The profile element can also be designed as a T-profile and serve as a support profile or end profile.

In possible embodiments, the L-profile has a base and a leg, and the mounting area is connected on the bottom of the base, where the area of the base is larger than the mounting area. The L-profile can be attached to a wall or floor with its floor and associated mounting area. The advantage of the L-profile is that it can be cut to size, as end sections are not connected to the sealing element.

In possible embodiments, in addition to the L-profile in the installation position, a clamping profile can also be attached, in particular to accommodate a shower wall. In combination with the clamping profile, the L-profile is suitable for receiving flat objects and holding them in place by means of a clamping effect. The clamping profile can have a U-shaped cross-section which serves as a holder. The clamping profile can be attached to the sealing element when the L-profile is installed, i.e. the overlapping areas of the profile system are already glued to a wall or floor. The clamping profile can also only be attached after the floor or wall covering has already been applied. In the latter application, the leg of the L-profile has a length that exceeds the thickness of the floor or wall covering. The L-profile can run through a tile joint or be arranged on a wall. The wall covering may hit the profile. This makes it possible to attach the clamping profile above the covering. The clamping profile is preferably connected to the leg of the L-profile. The clamping profile can be screwed to the leg.

In possible embodiments, the attached clamping profile has at least one elastic clamping area and can be adjusted in the horizontal plane. Any means with a resilient or easily bendable design is suitable as an elastic clamping area. By inserting an object into the clamping area, this flexible and/or resilient means is moved to the side. At the same time, a restoring force exerts a holding force on the object. The clamping profile can also be individually adjusted in perpendicular position to the wall surface or the floor surface. This depth adjustability can be achieved by moving the clamping profile along the leg.

In possible embodiments, a height-adjustable surge bar profile can still be attached to the L-profile in the installation position.

In possible embodiments, the profile element is provided as a U-profile to accommodate glass, decorative elements and/or panels.

In possible embodiments, the profile element is provided as a magnetic strip which can be connected to a magnetic profile intended for, in particular, closing a shower door.

In possible embodiments the profile element can seal an adjoining wall, ceiling or floor area very well due to the mounting with the sealing element and at the same time having a loose overlap area. In particular, joint areas behind the sealing element can also be sealed.

Further forms and elements of the disclosed profile system arises within the scope of the following claims as well as the following figure description and drawings. Other objects and features of the disclosed profile system will become apparent as the description proceeds, especially when taken in conjunction with the accompanying drawing sheets illustrating one or more non-limiting embodiments.

DETAILED DESCRIPTION

The position designations used below, such as top, bottom, front, rear, right and left, refer, from the point of view of the observer, to a disclosed profile system in the installation position and arranged in front of the observer.

Figure 1:
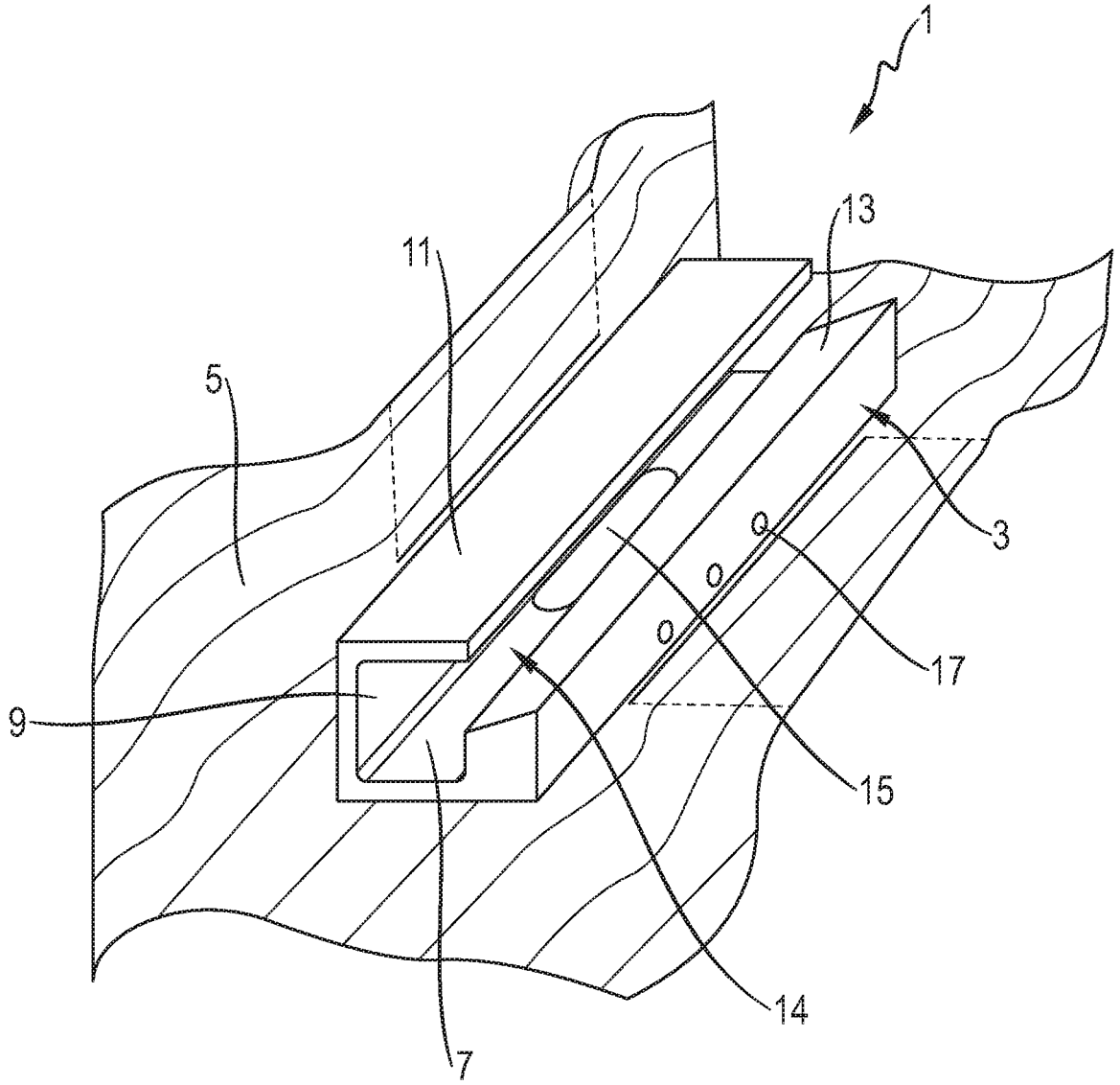
FIG. 1 is a perspective representation of a first embodiment profile system in an inclined view from the front.
Figure 2:
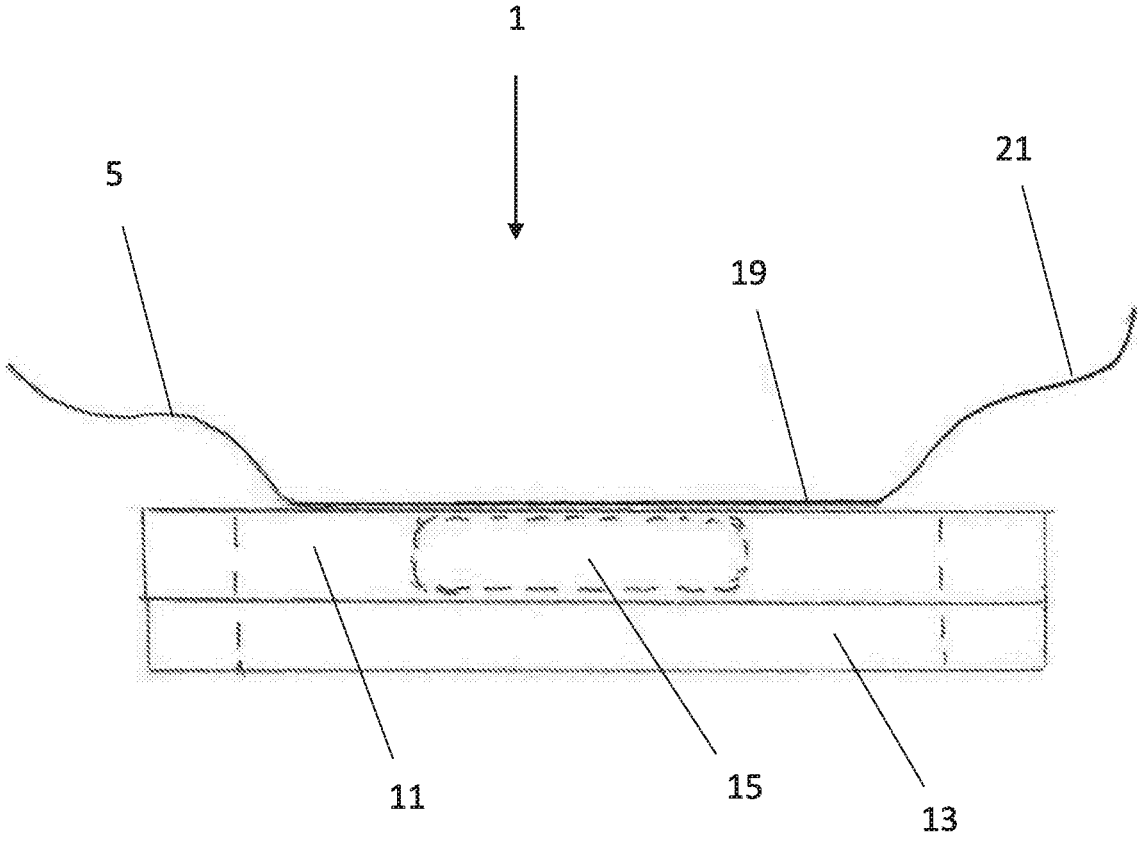
FIG. 2 is a top view of the profile system shown in FIG. 1.
Figure 3:
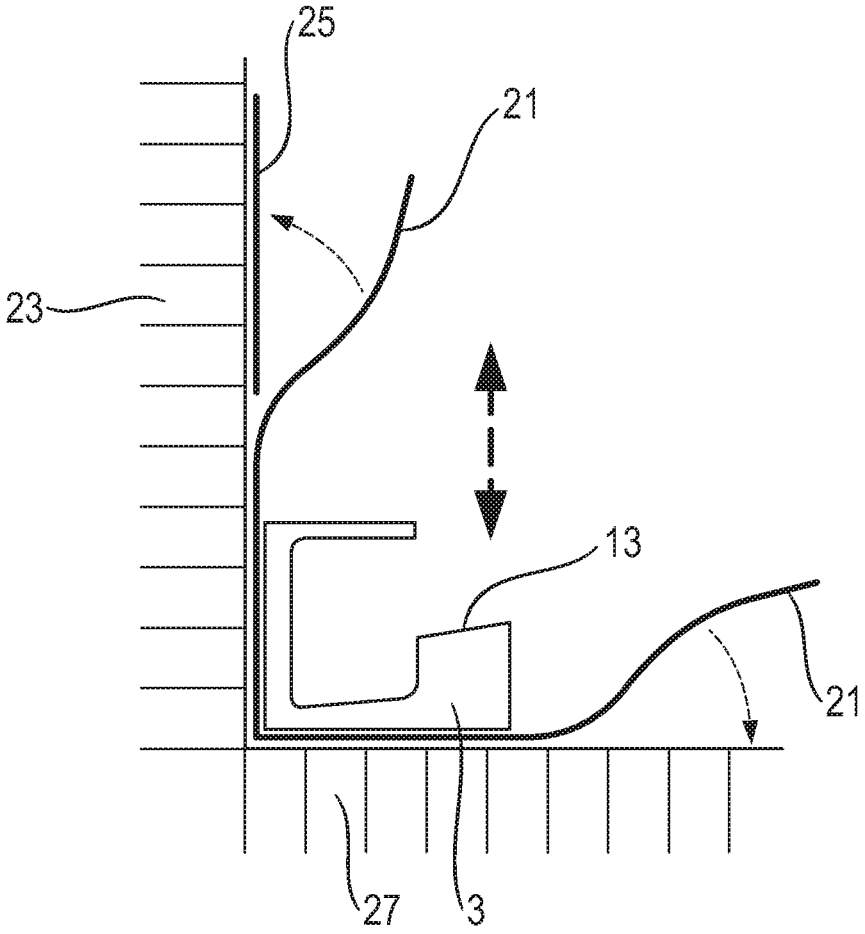
FIG. 3 is a cross-section of the profile system shown in FIG. 1 arranged on a wall surface.
Figure 4:
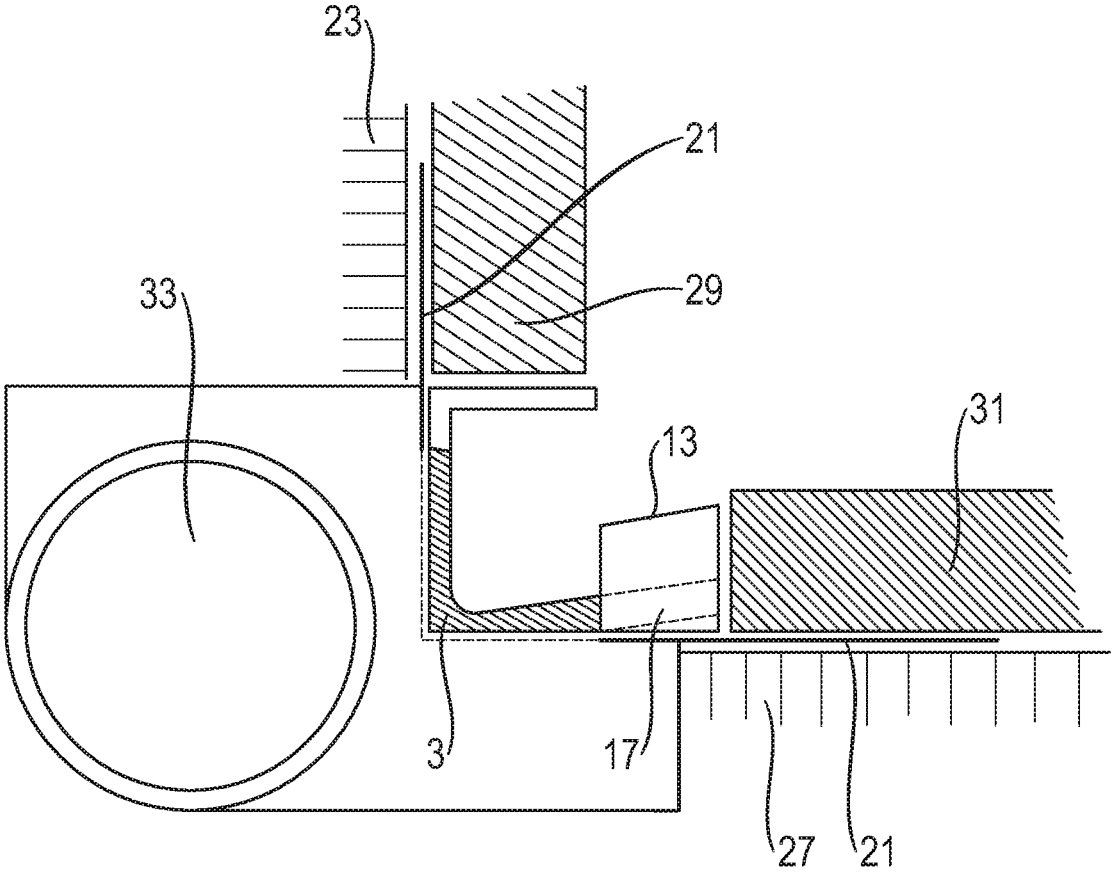
FIG. 4 is a cross-section of the profile system shown in FIG. 1 in the installation position.

The structure of a first embodiment profile system is first explained using FIGS. 1 to 4 for an initial design. FIGS. 1 and 2 show the first version of the profile system in a non-installed state, whereas FIG. 3 shows the first version in a partially installed state and FIG. 4 shows the first version of the profile system in an installed state.

As shown in FIG. 1, the profile system 1 of the first design includes a collection profile 3 and a sealing element 5 which are fixed together. The collection profile 3 is a collection profile for shower water. Collection profile 3 is intended for installation in or on a wall.

The collection profile 3 is U-shaped and has a base 7, a back wall 9 and a top panel 11. Furthermore, an inlet slope 13 extends along the bottom 7 in the direction of the side facing away from the back wall 9 in one piece with the U-profile. The inlet slope has a slope towards the bottom 7 of the collection profile 3. Floor 7 thus forms a drain channel. Between the floating edge of the upper floor 11 and the inlet slope 13 there is a lateral opening 14 or a gap through which water can flow from a shower floor via the inlet slope 13 to the floor 7 of the collecting profile 3.

Floor 7 also has an outlet opening 15 through which water can drain into a siphon, for example. The outlet opening 15 is slit-shaped and arranged in the middle of the collecting profile 3. The bottom 7 can have a slope towards the outlet opening 15 to improve water drainage. Water is discharged through the outlet opening 15 into a drain or siphon (as shown in FIG. 4).

The collection profile 3 also has three drainage channels 17 in the area of the inlet slope 13, which open from the outside above the film 5 into the outlet opening 15. The drainage channels, which extend through the continued inlet slope, serve as secondary drainage if water enters the area between the inlet slope 13 and a covering such as tiles (see also FIG. 4).

The cut-to-size collection profile 3 can also have at least one profile end piece (not shown) that can be connected detachably to an open end of collection profile 3. The collection profile 3 may have two open ends, each of which is shut off hermetically against fluids by means of a profile end piece. The profile end pieces or end caps are preferably used after the collection profile 3 has been cut to the installation length.

The sealing element 5 is flat and flexible and is designed as a foil or the like. In accordance with the design shown in FIGS. 1 and 2, the foil has a mounting area 19. This area is used for fixing the foil with the collector profile 3. The foil can be glued or otherwise fastened to the collection profile 3 in the mounting area 19. Similarly, the collection profile 3 may have an area containing a fastener, such as an adhesive, whereby the collection profile 3 is factory bonded to the sealant 5. The mounting area 19, i.e. the area of the foil that is glued to the collector profile 3, extends over the base 7 and the back wall 11 of the collector profile 3. The mounting area 19 does not extend over the entire length of the collection profile 3. Thus the collection profile 3 has a section at both ends of the base 7 and the back wall 9 which is not connected or glued to the foil but overlapped by the foil.

The sealing element 5 of the first embodiment profile system overlaps the base 7 and the back wall 9 of the collection profile 3 in longitudinal and transverse direction. This is shown in particular in FIGS. 1 and 2. FIG. 2 shows the profile system consisting of collection profile 3 and the sealing element 5, whereby the collection profile is shown through the top floor 11 with the outlet opening 15 and the inlet slope 13 in a plan view. The sealing element 5 is divided into mounting area 19 and overlapping area 21. The mounting area does not extend over the entire length of the collection profile 3. The overlap area 21 of the foil is movable and loose when not installed. Due to the extension of the mounting area 19 less than the length of the collection profile, the entire area of the movable overlap area 21 does not overlap the collection profile 3. The overlap area 21 is designed in such a way that part of the overlap area 21 overlaps over one side of the collection profile 3 if the overlap area 21 lies against the back wall 9. In other words, the total length of the sealing element 5 is greater than the total length of the collection profile 3, so there is an overlap. As shown in FIG. 1, the total width of the sealing element 5 is also greater than the width of the collection profile 3.

The overlap area 21 can be folded away, which enables the collection profile 3 to be cut to a certain length (the vertical dashed lines in FIG. 2 are examples of cutting marks). The collection profile 3 can be shortened at both ends so that a precisely fitting length of the collection profile 3 can be achieved for use in a shower. The foil can also be cut accordingly.

FIG. 3 shows the first version of the profile system in which the collection profile 3 is arranged on a wall surface 23. The back wall 11 of the collection profile 3 is parallel to the wall surface on wall 23. The overlap area 21 is laid or sealed to the wall surface via an existing sealing foil 25. The floor 7 of the collection profile 3 is parallel to a floor surface 27. The corresponding part of the overlap area 21 is placed on the floor surface 27.

The collection profile 3 can be flexibly positioned vertically in this layout. For example, it is possible to adjust the height of the collection profile 3 if the profile system 1 is already in the installation position. The advantage of this is that the profile system 1 with its inlet slope 13 can be easily adapted to the existing floor covering level. The concrete layout of the collection profile 3 in the vertical can be achieved by moving the overlap area 21 vertically. In particular, the foil can be moved within an adhesive located on the floor/wall for fixing with a floor/wall covering in order to align the profile system.

FIG. 4 now shows the first version of the profile system 1 in the installation position or in the assembled state. The collection profile 3 of the first design is in a wall installation position, i.e. the U-shaped part of the collection profile 3 is essentially below a wall covering 29. Floor 7 runs parallel to the floor surface, back wall 9 parallel to wall surface 23 and top floor 11 parallel to a side surface of wall covering 29. Wall covering 29 is attached to wall surface 23 on overlap area 21 in the form of tiles. The overlap area is thus at least partially fastened by the tile adhesive. The upper surface of the upper floor 11 is adjacent to the side surface of the wall covering 29. Furthermore, the upper floor has a width so that it is approximately flush with the wall covering surface 29. Advantageously, the flat overlap area 21 and the mounting area 19, which is attached to the profile element 3 at the factory, ensure both sealing and reliable mounting of the profile element 3.

The inlet slope 13 extends from floor 7 to a floor covering 31, so that water on the floor covering 31 can flow into the collection profile 3 via the slope of the inlet slope 13. The floor covering 31 can have a gradient in the direction of the inlet slope 13 to ensure better drainage of the water. Water that accumulates between the inlet slope 13 and floor covering 31 due to leakage or a material defect is drained via drainage channels 17 to siphon 33.

Floor covering 31 is tiled on floor area 27 above overlap area 21. In the installed state, as shown in FIG. 4, the overlap area 21 is in any case partially enclosed and fixed between the floor 31 or wall covering 29 and the floor 27 or wall surface 23. The fixing is achieved by partially gluing the overlapping area 21 with tile adhesive and by pressing the overlapping area 21 against the respective wall or floor surface by the weight of the covering.

Furthermore, FIG. 4 shows a siphon 33 which is connected to the profile system. The siphon 33 can be firmly connected to the profile system at the factory with foil between it. However, the siphon 33 can also be connected loosely to the profile system. The outlet opening 15 in the collection profile 3 serves to drain water into a drain pipe of siphon 33. The foil encloses the outlet opening 15 all around as it is firmly bonded so that there is a continuous foil seal behind/below/next to the collection profile 3.

Figure 5:
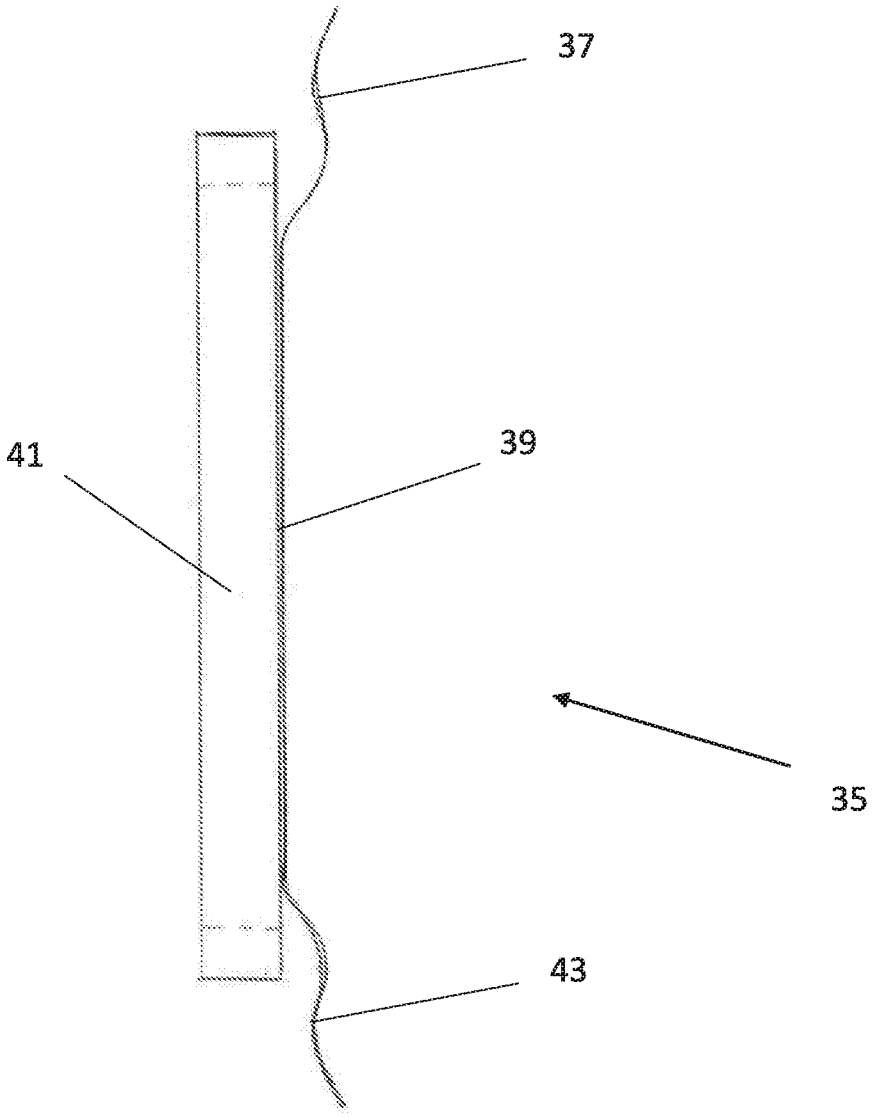
FIG. 5 is a top view of a second embodiment profile system'
Figure 6:
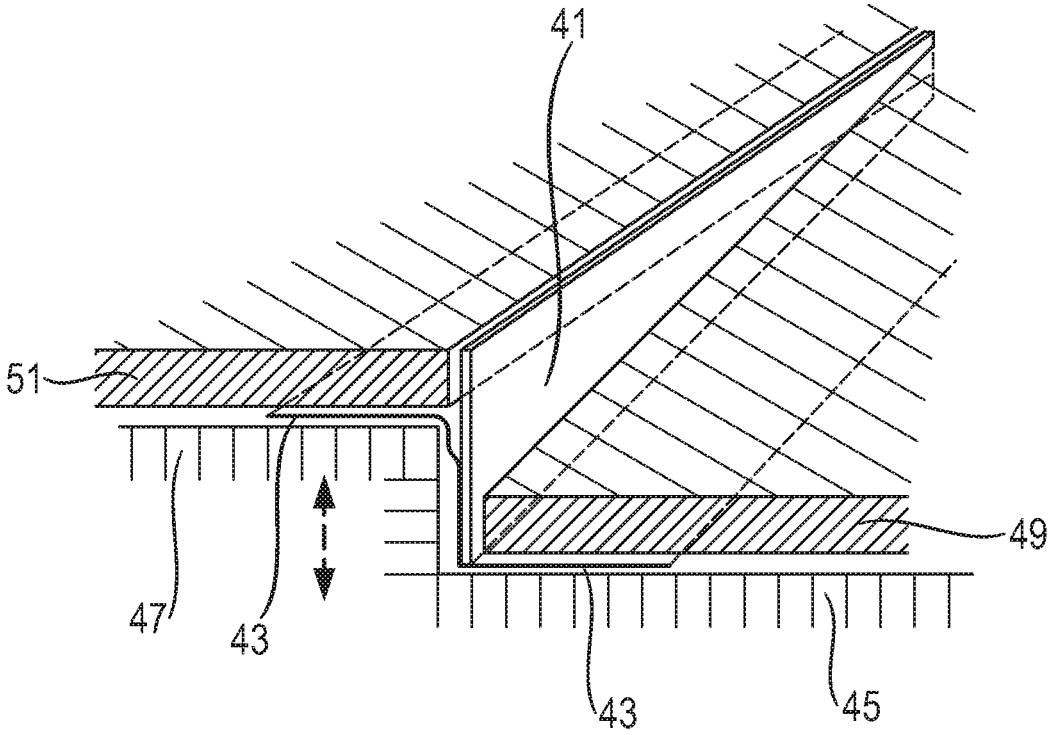
FIG. 6 is a perspective cross-sectional view of the profile system shown in FIG. 5.

FIG. 5 shows a second embodiment of the disclosed profile system in the non-installed state, whereas FIG. 6 shows the second embodiment of the profile system in the installation position or in the installed state.

As shown in FIG. 5, the second embodiment profile system 35 includes a trim strip 41 or a gradient wedge and a sealing element 37 which are fixed together.

The sealing element 37 is flat and flexible and is designed as a foil or similar. The foil has a mounting area 39. This area is used for mounting the foil with the trim strip 41. The foil is glued or otherwise fastened to the trim strip 41 in the mounting area 39. Similarly, the trim strip 41 may have an area containing a fastener such as adhesive, whereby the trim strip 41 is bonded to the sealing element 37. The mounting area 39, i.e. the area of the foil bonded to the trim strip 41, extends at least partially over a side surface of the trim strip 41. The mounting area 39 does not extend over the entire length of the trim strip 41. Thus the trim strip 41 has a section at each end that is not connected or glued to the film.

The sealing element 37 of the second embodiment overlaps the trim 41 in the longitudinal and transverse directions. FIG. 5 shows the profile system 35 consisting of trim strip 41 and sealing element 37, whereby the trim strip 41 is shown in a top view. The sealing element 37 is divided into mounting area 39 and overlapping area 43. The mounting area 39 does not extend over the entire length of the trim strip 41. The overlap area 43 of the foil is movable when not installed. Due to the extension of the mounting area 39 less than the length of the trim strip, the entire area of the movable overlap area 43 does not overlap the trim strip 41. The overlap area 43 is formed in such a way that a part of the overlap area 43 overlaps over one side of the trim strip 41 when the overlap area 43 is in contact with the side wall of the trim strip 41. In other words, the total length of the sealing element 37 is greater than the total length of the trim strip 41, so there is an overlap.

The overlap area 43 can be folded away, allowing the trim strip 41 to be cut to a certain length (the horizontal dashed lines in FIG. 5 are examples of cutting marks). The trim strip 41 can be shortened at both ends so that the trim strip 41 can be exactly the right length for use in a shower. The foil can also be cut accordingly.

FIG. 6 shows an installed condition of the second embodiment profile system 35. The trim strip 41 is installed in a shower with a floor slope. The floor covering 49 has a gradient. This creates a height offset in relation to the floor covering 51 next to the shower area. Floor covering 49, 51 can be provided in the form of tiles. At the same time, the gradient in floor 45 results in a difference in height compared to floor 47 within the shower area. As the gradient in floor 45 continues, the difference in height from floor 47 increases. Floor 45 is the floor in the shower area, whereas floor 47 is the floor next to the shower.

The trim strip 41 has a wedge-shaped shape which essentially corresponds to the vertical surface of the height offset. When installed, the trim strip 41 is arranged parallel to the vertical surface. The overlap area 43 is located between the respective floor covering 49, 51 and the respective floor 45, 47. Before the floor covering 49, 51 is fixed to the floor 45, 47, the height of the trim strip 41 can be adjusted by gluing the overlap area 43 at different heights.

Figure 7:
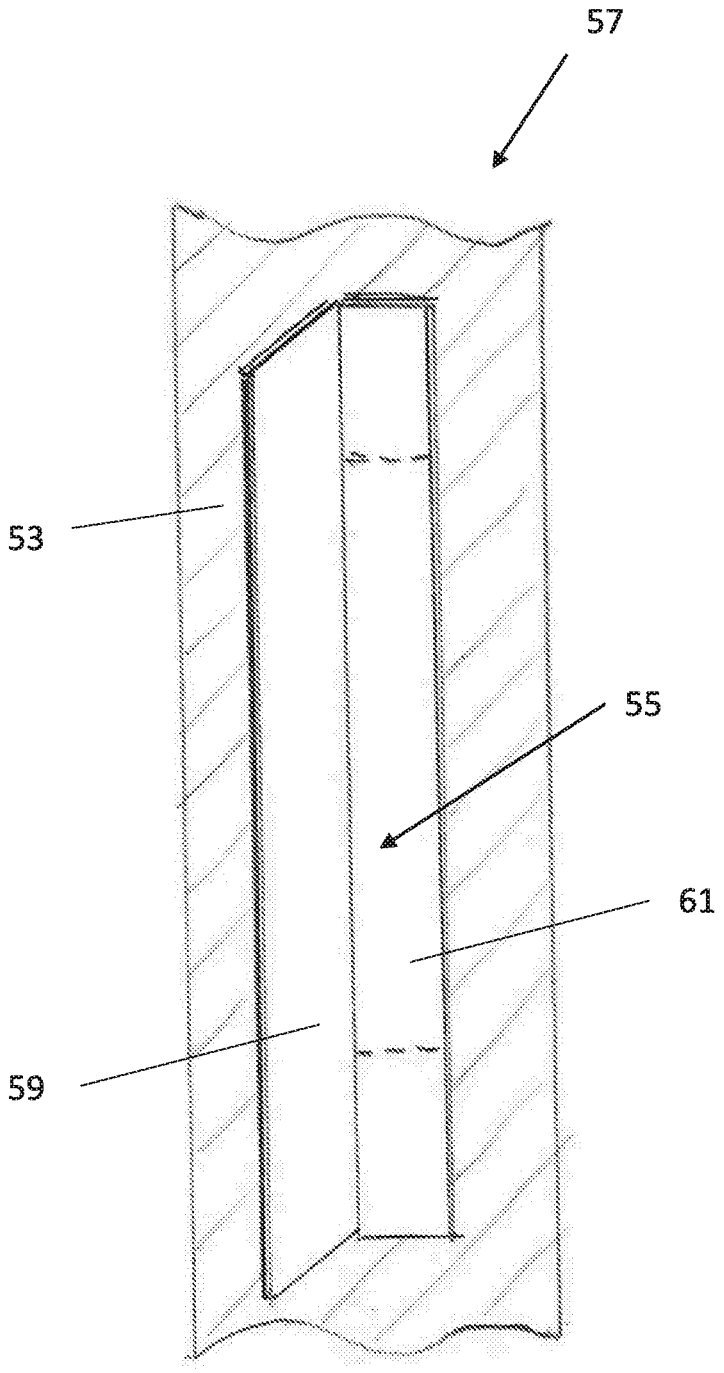
FIG. 7 is a perspective representation of a third embodiment profile system from the front.
Figure 8:
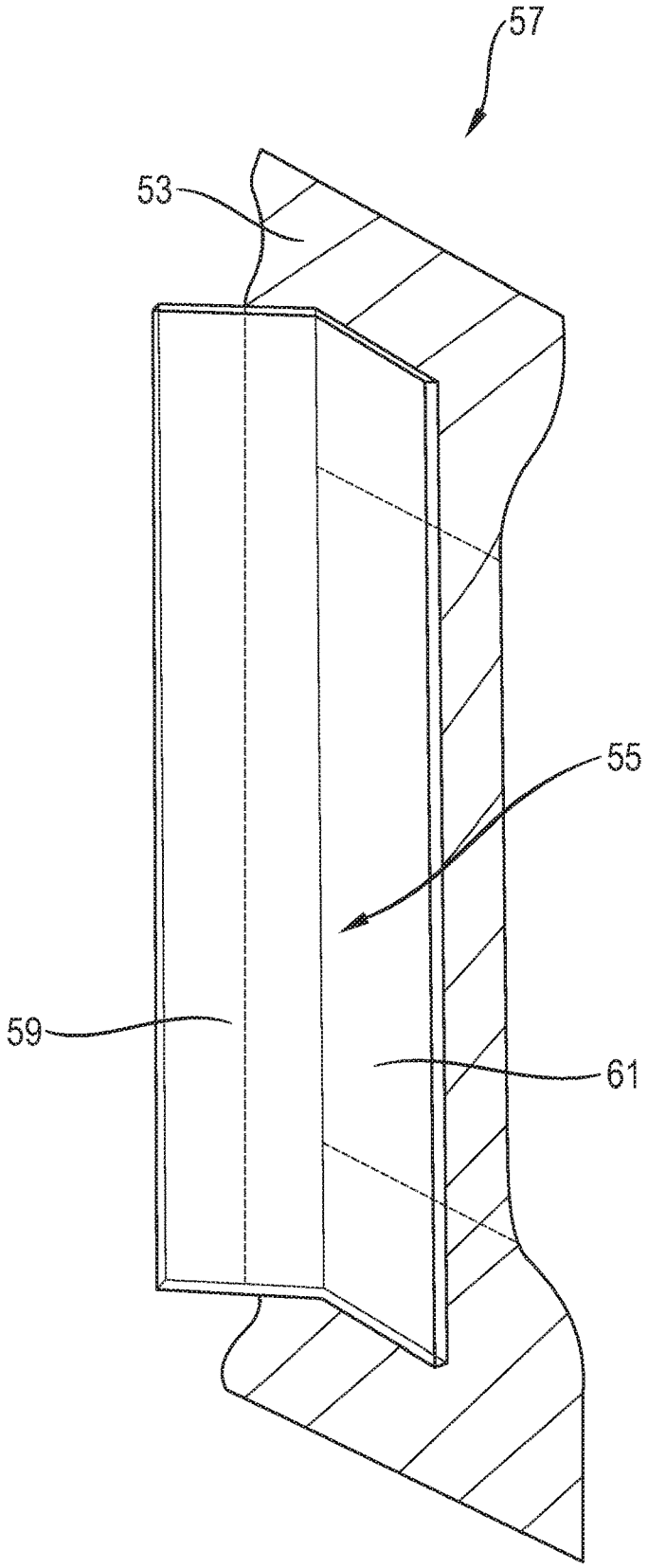
FIG. 8 is a perspective view of the profile system shown in FIG. 7 in an inclined view from the front.
Figure 9:
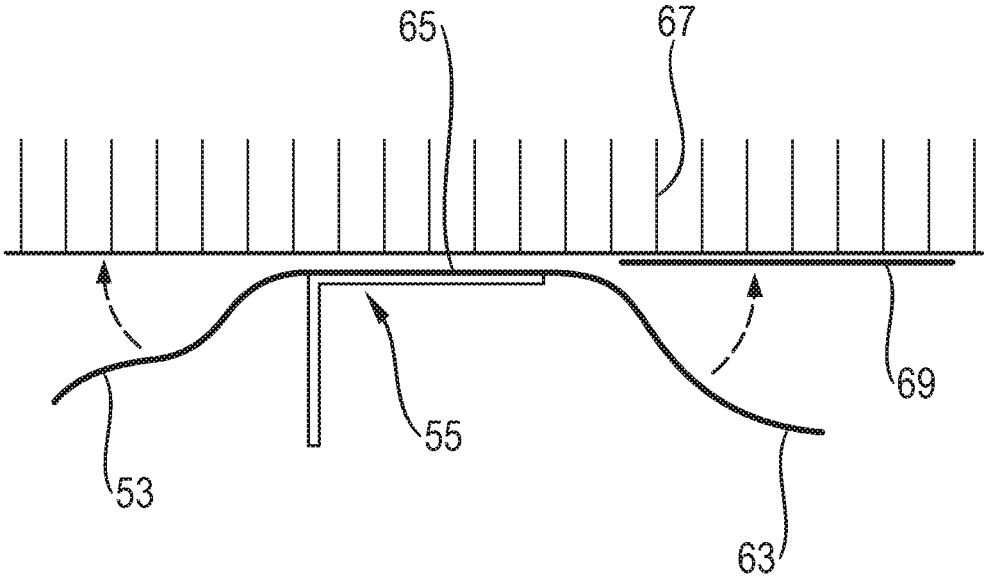
FIG. 9 is a cross-section of the profile system shown in FIG. 7, the profile system arranged on a surface.
Figure 10:
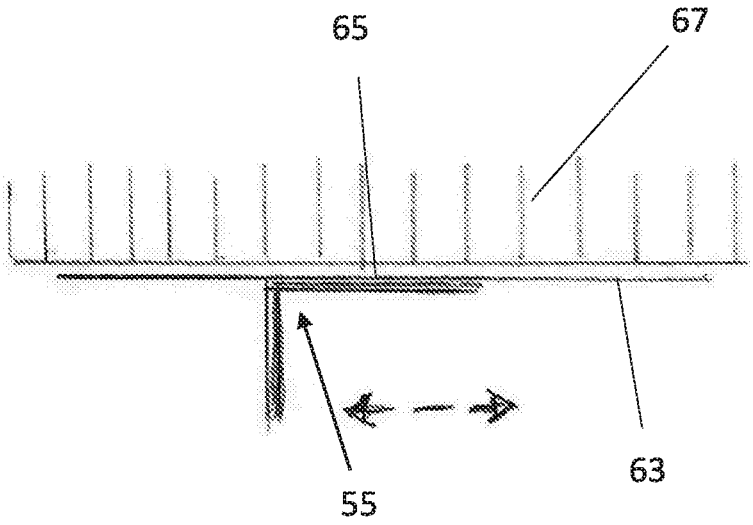
FIG. 10 is a cross-section of the profile system shown in FIG. 7 in a partially installed position.
Figure 11:
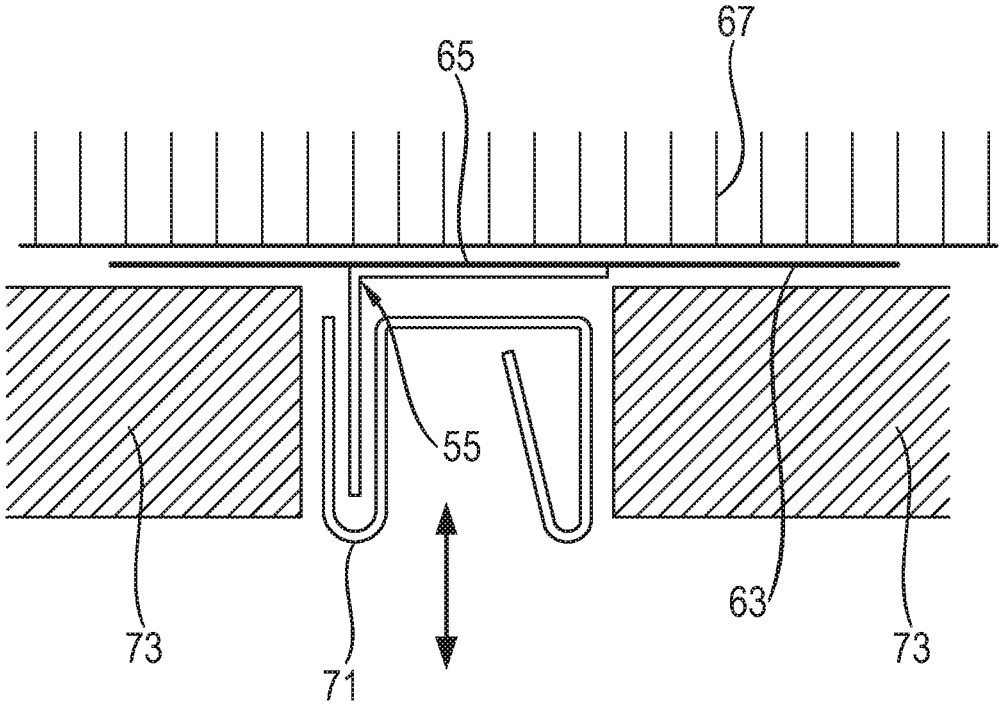
FIG. 11 is a cross-section of the profile system shown in FIG. 7 in use.
Figure 12:
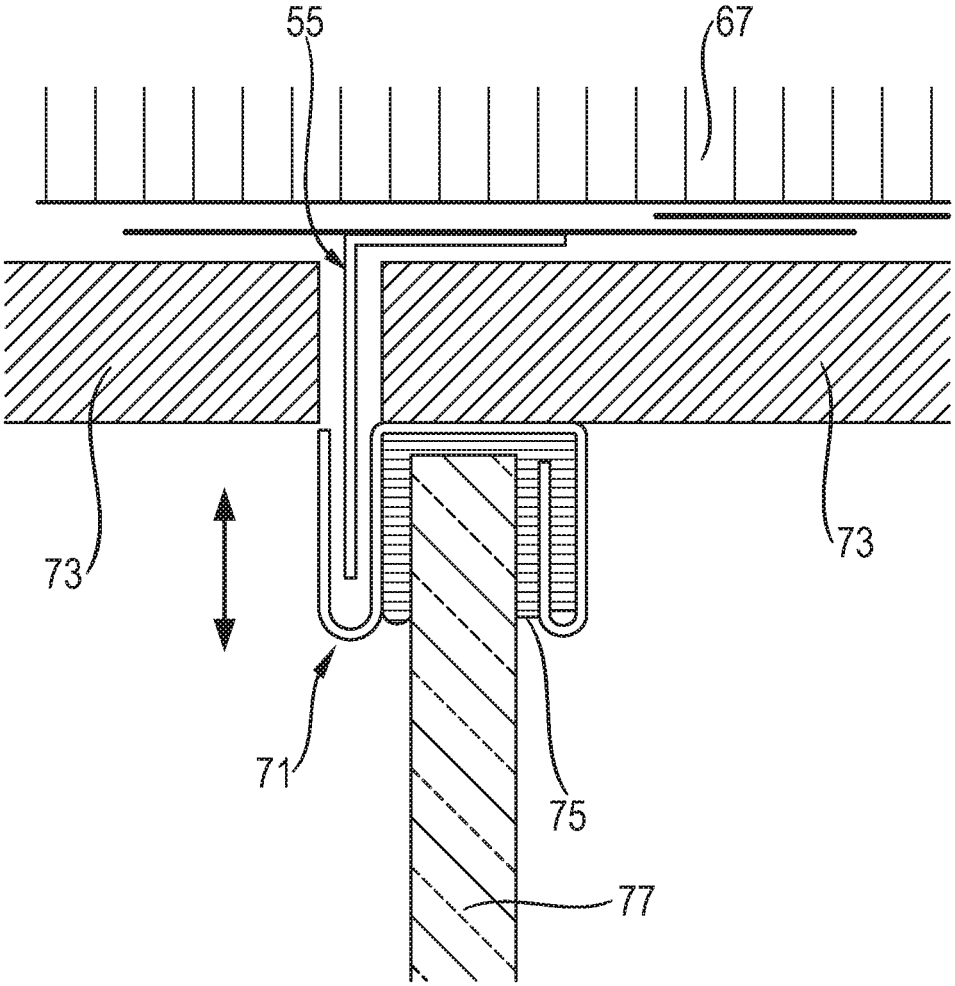
FIG. 12 is a cross-section of the profile system shown in FIG. 7 in a further use.
Figure 13:
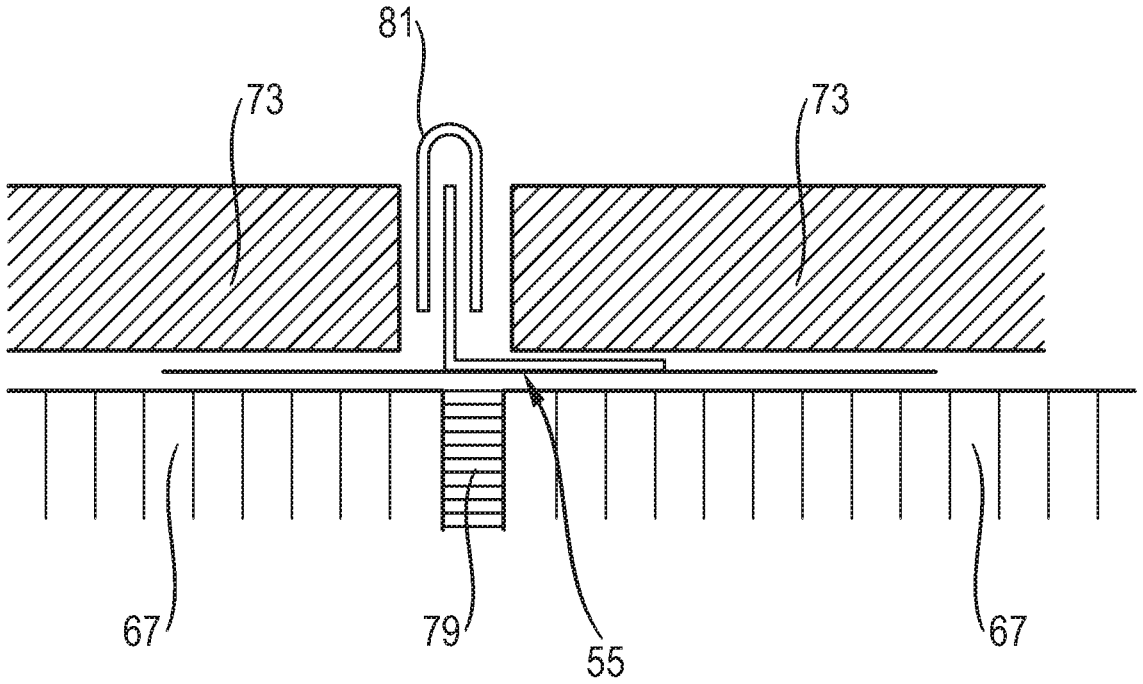
FIG. 13 is a cross-section of the profile system shown in FIG. 7 in a further use.

FIGS. 7 and 8 show a third embodiment of the disclosed profile system in a non-installed state, whereas FIGS. 9 and 10 show the third embodiment of the profile system in a partially installed state. FIGS. 11 to 13 show the third embodiment of the profile system when installed.

As shown in FIGS. 7 and 8, the third embodiment profile system 57 includes an L-profile 55 and a sealing element 53, which are fixed together.

The L-profile 55 has a base 61 and a leg 59, which have an L-shape in the profile. The width of the leg 59 may differ from the width of the base 61.

The sealing element 53 is flat and flexible, designed as a foil or similar. The foil has a mounting area of 65. This area is used for fixing the foil with the L-profile 55. The foil is glued to the L-profile 55 in the mounting area 65 or otherwise fixed. Similarly, the L-Profile 55 may have an area containing a fastener such as adhesive, whereby the L-Profile 55 is bonded to the sealing element 53. The mounting area 65, i.e. the area of the film bonded to the L-profile 55, extends at least partially over the bottom 61 of the L-profile 55 (see horizontal dashed lines in FIG. 7). The mounting area 65 does not extend over the entire length of the L-profile 55. This means that the L-profile 55 has a section at each end that is not connected or glued to the foil (see FIGS. 7 and 8).

In any case, the sealing element 53 of the third embodiment profile system overlaps the bottom 61 of the L-profile 55 in the longitudinal and transverse directions. FIG. 9 shows the profile system 57 consisting of the L-profile 55 and the sealing element 53, whereby the L-profile 55 is shown in a top view. The sealing element 53 is divided into the mounting area 65 and an overlapping area 63. The mounting area 65 does not extend over the entire length of the L-profile 55 (see also FIG. 8). The overlap area 63 of the foil can be moved when not installed. Due to the extension of the mounting area 65 in length less than the L-profile length, the entire area of the movable overlap area 63 does not overlap the L-profile 55. The overlap area 63 is designed in such a way that part of the overlap area 63 overlaps over one side of the L-profile 55 when the overlap area 63 is at the bottom of the L-profile 55. In other words, the total length of the sealing element 53 is greater than the total length and width of the bottom of the L-profile 55, so there is an overlap.

The overlap area 63 can be folded away, allowing the L-profile 55 to be cut to a specific length. The L-profile 55 can be shortened at both ends so that the L-profile 55 can be cut to a precise length for use in a shower. The foil can also be cut accordingly.

In the partially installed state, as shown in FIGS. 9 and 10, the third embodiment profile system is arranged on a wall or on a floor. In particular, the floor of the L-profile 55 is located on the wall or on the floor 67. The loose overlap area 63 of the sealing element 53 is sealed above or below an existing sealing foil or sealing 69.

The L-profile 55 can be flexibly positioned vertically and horizontally in the layout shown in FIG. 9. For example, it is possible to adjust the vertical position of the L-profile 55 if the profile system is already in the installation position. This has the advantage that the height of the profile system can be easily adjusted. The concrete arrangement of the L-profile 55 in the vertical can be achieved by moving the overlap area 63 vertically. In particular, the film can be moved in an adhesive located on the floor/wall for fixing with a floor/wall covering in order to align the third type profile system.

As shown in FIG. 10, the overlap area 63 is now sealed parallel to the wall or floor. This can be done by gluing. The shiftability of the L-profile 55 in the adhesive bed is still possible in this state. The aforementioned structure of the profile system from the L-profile 55, to which the sealing element 53 is attached, thus enables simple alignment of the L-profile 55 during assembly.

As shown in FIG. 11, the L-profile 55 can be designed as a support profile. An additional clamping profile 71 is attached to the L-profile 55. The clamping profile 71 is depth-adjustable, depending on how far it is applied over the leg of the L-profile 55. In addition, the clamping profile 71 has a tab that presses against an object held in the clamping profile 71 and thereby holds it in place. A clamping profile arranged in this way makes it possible, for example, to hold glass between the floor or wall covering 73.

As shown in FIG. 12, the leg of the L-profile 55 can extend through a joint (e.g. a joint between two tiles 73). The clamping profile 71 then sits on the surface of the covering. The clamping profile 71 is still depth-adjustable and can therefore be adapted to the depth depending on the thickness of the covering. Compared to FIG. 11, the clamping profile 71 differs in that it also has a plastic profile insert 75 to protect glass 77 clamped in the clamping profile 71.

FIG. 13 shows another type of application based on an embodiment of a profile system with an L-profile 55. The L-profile 55 is arranged on a wall or floor surface 67 in such a way that it seals a joint in the floor (e.g. an expansion joint) or in a wall. This is done by placing the foil of the profile system completely over the joint. In addition, a height-adjustable overflow molding profile 81 is arranged on the leg of the L profile 55.

Figure 14:
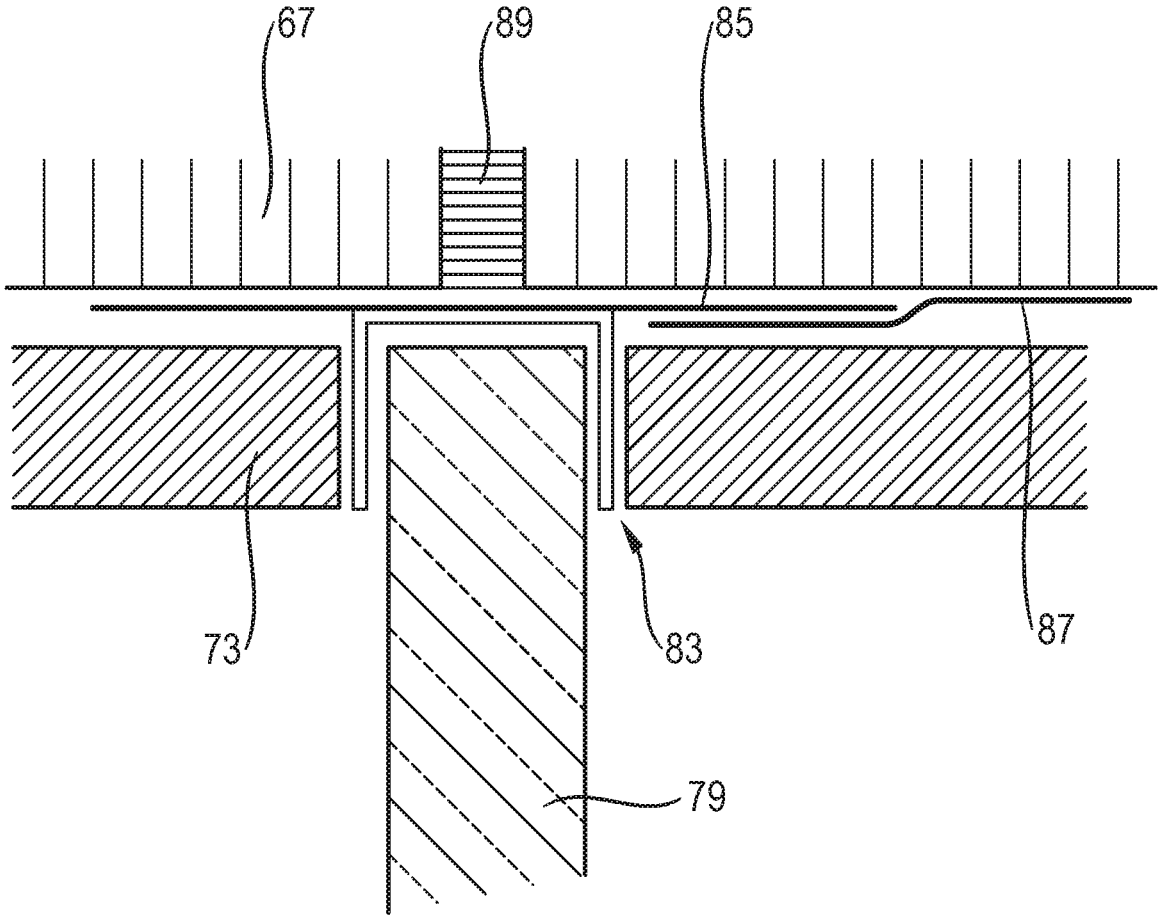
FIG. 14 is a cross-section of a fourth embodiment profile system in an installation position.

FIG. 14 shows another embodiment of the disclosed profile system. The profile system consists of a U-profile 83 and a sealing element 85 attached to it. The sealing element 85 can be a foil which has a mounting area which is glued to the floor of the U-profile 83 and which has an overlapping area which is arranged between a wall or floor 67 and a wall or floor covering 73. The foil sealing is done by applying an existing sealing foil 87 over the foil 83 of the profile system. The U-profile 83 is used to accommodate an object 79 such as glass. This arrangement of the profile system also enables the sealing of a wall or floor joint 89.

Figure 15:
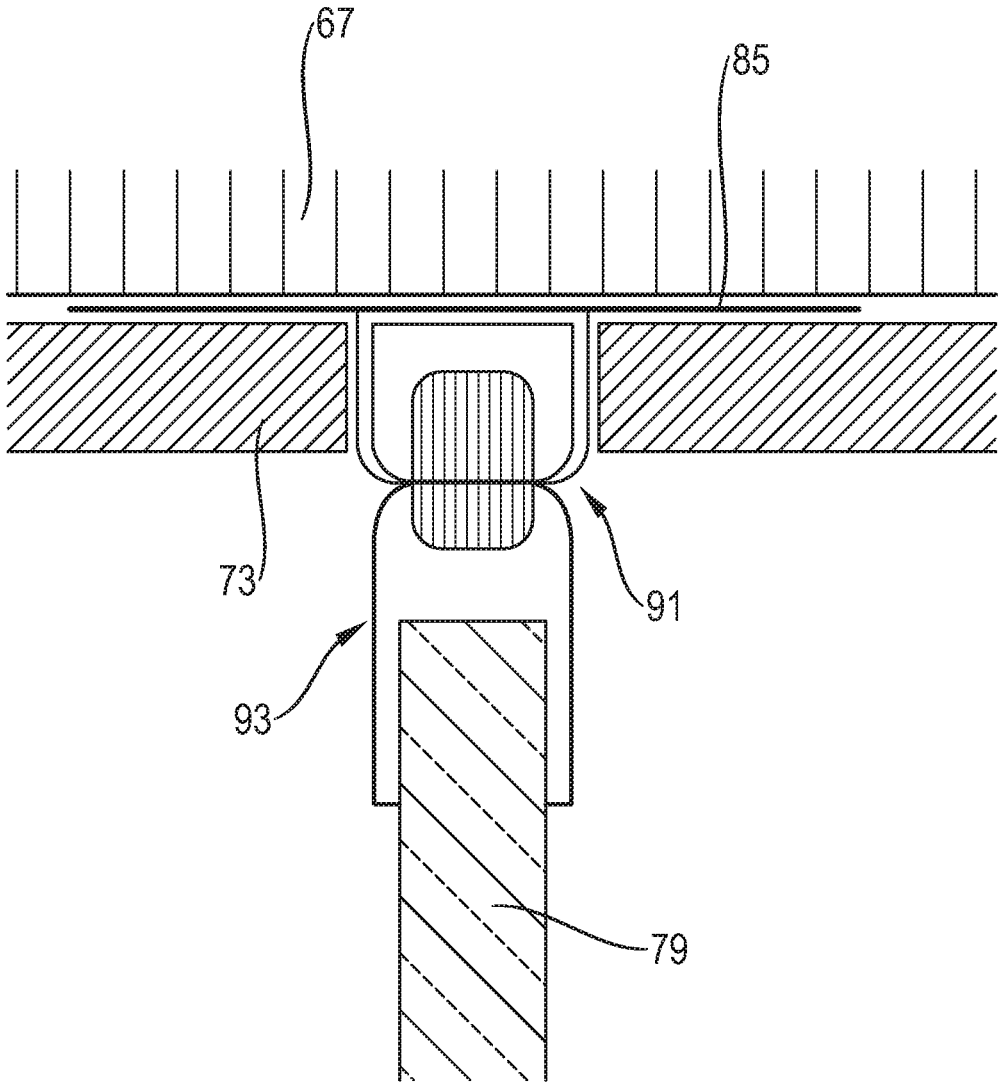
FIG. 15 is a cross-section of the profile system shown in FIG. 14 in the mounting position.

FIG. 15 shows another embodiment of the disclosed profile system. The profile system consists of a magnetic strip 91 and a sealing element 85 attached to it. When installed, the magnetic strip 91 is located between the floor covering 73. A magnetic profile 93 can be connected to the magnetic strip 91 and is attached to a glass 79 that functions as a shower door.

Figure 16:
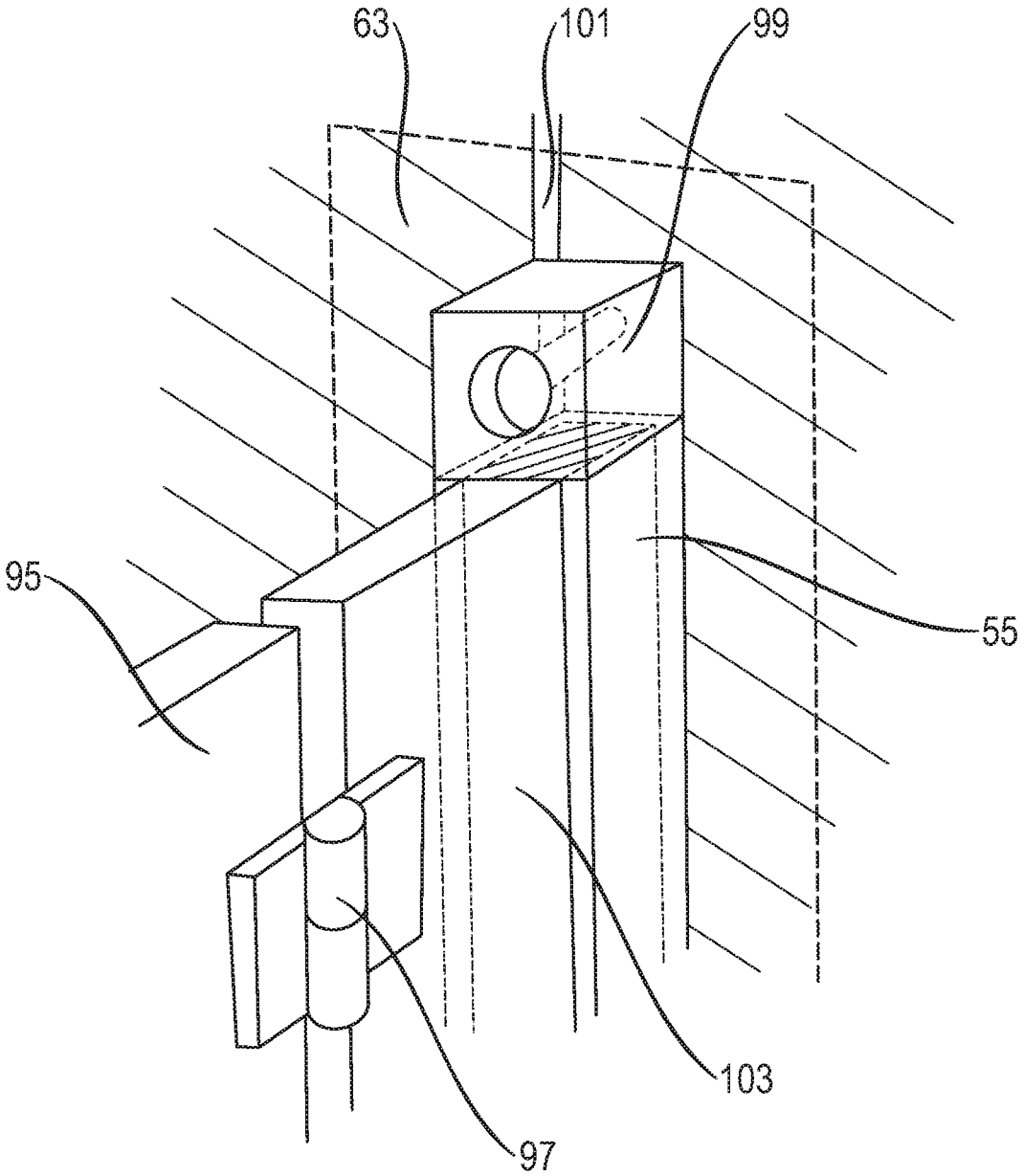
FIG. 16 is a perspective representation of the profile system shown in FIG. 7 in a further use.

Finally, FIG. 16 shows a perspective illustration of an application of the disclosed profile system with an embodiment having an L-profile 55 in installation position. In addition to the L-profile 55, the profile system consists of a sealing element 63 secured with it. This system is mounted on a wall, as described above for FIG. 12. The L-profile 55 is used in conjunction with a clamping profile to accommodate a glass fixed part 103, which in turn is connected via a hinge 97 to a glass door 95. In order to support the weight of the glass door 95, a screw-on cuboid 99 is located on the L-profile 55. Between the cuboid and the L-profile 55 there is a rubber intermediate layer. The fixed cuboid 99 prevents the glass fixed part 103 from tilting forwards out of the profile.

Further explanations of the disclosed profile system are disclosed within the scope of the following claims. While one or more embodiments have been disclosed and described in detail, it is understood that this is capable of modification and that the scope of the disclosure is not limited to the precise details set forth but includes modifications obvious to a person of ordinary skill in possession of this disclosure, including (but not limited to) changes in material selection, size, shape, configuration, or use application.

What is claimed is:

1. Profile system for attachment to one or more surfaces of a sanitary installation, the profile system comprising:

a profile element, the profile element being an elongate body extending in a length direction between spaced-apart opposite first and second ends of the body spaced apart by a length of the profile element, the body comprising a first outer surface extending the length of the profile element from the first end of the body to the second end of the body and extending transverse to the length direction between spaced-apart opposite edges of the first outer surface;

a sealing element for sealing between the profile element and the one or more surfaces of the sanitation installation, the sealing element being formed from a flat, flexible, and foldable membrane impermeable to water; and a fastener;

the sealing element comprising a mounting area and an overlapping area, the mounting area being fixed to the first outer surface of the profile element by the fastener;

the overlapping area surrounding the mounting area and being loose and movable with respect to the profile element away from the profile element;

the overlapping area being extendable beyond the ends of the profile element and being extendable beyond the edges of the first outer surface whereby the overlapping area of the sealing element can extend beyond the edges of the first outer surface when the first outer surface of the profile element is against a surface of the one or more surfaces of the sanitary installation; and wherein the mounting area of the sealing element is disposed between the first and second ends of the profile element but does not extend the length of the profile element whereby the first and second ends of the profile element are each spaced away from the mounting area.

2. Profile system for attachment to one or more surfaces of a sanitary installation, the profile system comprising:

a profile element, the profile element being an elongate body extending in a length direction between spaced-apart opposite first and second ends of the body spaced apart by a length of the profile element, the body comprising a first outer surface extending the length of the profile element from the first end of the body to the second end of the body and extending transverse to the length direction between spaced-apart opposite edges of the first outer surface;

the profile element defining a channel extending along the length of the profile element and open at the ends of the body, the channel partially surrounded by the first and second outer surfaces of the profile element;

a sealing element for sealing between the profile element and the one or more surfaces of the sanitation installation, the sealing element being formed from a flat, flexible, and foldable membrane impermeable to water; and a fastener;

the sealing element comprising a mounting area and an overlapping area, the mounting area being fixed to the first outer surface of the profile element by the fastener;

the overlapping area surrounding the mounting area and being loose and movable with respect to the profile element away from the profile element;

the overlapping area being extendable beyond the ends of the profile element and being extendable beyond the edges of the first outer surface whereby the overlapping area of the sealing element can extend beyond the edges of the first outer surface when the first outer surface of the profile element is against a surface of the one or more surfaces of the sanitary installation;

the profile element comprising a plurality of openings spaced away from the first and second ends of the body and extending through the body from an exterior surface of the body, the plurality of openings being in fluid communication with the channel.

3. Profile system according to claim 1, wherein the profile element body comprises a second outer surface extending the length of the profile element from one end of the body to the other end of the body and extending from one edge of the first outer surface away from the first outer surface to an opposite edge of the second outer surface, and the overlapping area of the sealing element is extendable over the second outer surface and beyond the opposite edge of the second outer surface.

4. Profile system according to claim 3, wherein the fastener also fixes the mounting area of the sealing element to the second outer surface of the profile element.

5. Profile system according to claim 1, wherein the profile element defines a channel extending along the length of the profile element and open at the ends of the body, the channel partially surrounded by the first and second outer surfaces of the profile element.

6. Profile system according to claim 2, wherein the mounting area of the sealing element is disposed between the first and second ends of the profile element but does not extend the length of the profile element whereby the first and second ends of the profile element are each spaced away from the mounting area.

7. Profile system according to claim 2, wherein the body of the profile element is a U-shaped member comprising a lower base wall, an upper base wall spaced from the lower base wall, and a back wall connecting the upper base wall and the lower base wall, the back wall facing the channel;

the plurality of openings comprising at least one discharge opening formed as a through-hole extending through the lower base wall and fluidly connecting the channel with the exterior of the body; and the plurality of openings comprising at least one inlet opening, each at least one inlet opening formed as a hole extending from an exterior surface of the lower base wall to one of the at least one discharge opening.

8. Profile system according to claim 7, wherein the lower base wall extends away from the back wall to a free end having a surface facing away from the back wall, the hole of each at least one inlet opening extending from the said surface into the lower base wall.

9. Profile system according to claim 8, wherein each at least one inlet opening slopes towards an exterior surface of the lower base wall as the inlet opening extends into the lower base wall towards the one discharge opening.

10. Profile system according to claim 7, wherein the profile element comprises a second outer surface extending the length of the body and extending from one edge of the first outer surface away from the first outer surface to an opposite edge of the second outer surface;

the first outer surface of the body is disposed on the back wall and the second outer surface of the body is disposed on the lower base wall; and the fastener also fixes the mounting area of the sealing element to the second outer surface.

11. Profile system according to claim 10, wherein the first and second outer surfaces are each flat.

12. Profile system according to claim 10, wherein the overlapping area of the sealing element is extendable over the second outer surface and beyond the opposite edge of the second outer surface.

13. Profile system according to claim 12, wherein the mounting area of the sealing element is disposed between the first and second ends of the profile element but does not extend the length of the profile element whereby the first and second ends of the profile element are each spaced away from the mounting area.

14. Profile system according to claim 3, in which the body of the profile element has an L-profile or T-profile, the L-profile or the T-profile comprising a base and a leg, the first outer surface of the body being disposed on one of the base and the leg, the second outer surface of the body being disposed on the other of the base and the leg.

15. Profile element according to claim 3, wherein the body of the profile element is an "L"-shaped member comprising a pair of legs, the first outer surface on one leg of the pair of legs and the second outer surface on the other leg of the pair of legs.

16. Profile system according to claim 15, comprising a clamping profile being attached to one leg of the pair of legs of the profile element, the clamping profile comprising a pair of spaced-apart walls that define an empty gap between them, the spaced-apart walls being configured to receive into the gap an object that urges the spaced-apart walls away from one another to generate an interference fit between the object and the spaced-apart walls that holds the object in the clamping profile.

17. Profile system according to claim 16, wherein the clamping profile is attached to one leg of the pair of legs of the profile element and is adjustably positioned along the length of the one leg.

18. Profile system according to claim 17, comprising an insert disposed between the spaced-apart walls of the clamping profile, the insert defining a slot to receive an object inserted into the gap whereby an object that would otherwise not generate an interference fit can be held by the clamping profile.

19. Profile system according to claim 15, comprising a U-shaped surge profile attached to one leg of the pair of legs of the profile element, the surge profile being adjustably positionable along the length of the one leg.

20. Profile system according to claim 1, wherein the body of the profile element is a U-shaped member comprising a base wall, an upper base wall spaced from the base, and a back wall connecting the upper base and base, the first outer surface being disposed on the back wall.

21. Profile system according to claim 1, wherein the first outer surface of the body of the profile element is disposed on a magnetic strip forming a portion of the body.

22. Profile system according to claim 1, wherein the fastener is an adhesive or a screw.

23. Profile system according to claim 1, wherein the overlapping area of the sealing element is attached to one or more surfaces of a sanitation installation, the one or more surfaces being adjacent to the profile element and fixing the profile element at an installation location of the sanitation installation with respect to the one or more surfaces.

24. Profile system for attachment to a sanitary installation, the profile system comprising:

a profile element, the profile element being an elongate body extending in a length direction between spaced-apart opposite first and second ends of the body spaced apart by a length of the profile element, the body comprising a first outer surface and a second outer surface;

the first outer surface extending the length of the profile element from the first end of the body to the second end of the body and extending transverse to the length direction between spaced-apart opposite first and second edges of the first outer surface;

the second outer surface extending the length of the profile element from the first end of the body to the second end of the body and extending transverse to the length direction from the second edge of the first outer surface to a third edge spaced apart from the second edge wherein the first and second outer surfaces are transverse to each other and the second edge is common to both the first and second outer surfaces;

the first and second outer surfaces being disposed on and forming outer surfaces of respective first and second walls of the body;

a sealing element for sealing between the profile element and one or more surfaces of the sanitation installation, the sealing element being formed from a flat, flexible, and foldable membrane impermeable to water; and the sealing element comprising a mounting area and an overlapping area, the mounting area being fixed to at least one of the first and second outer surfaces of the profile element;

the overlapping area surrounding the mounting area and being unattached to and movable with respect to the profile element;

the overlapping area being extendable beyond the ends of the profile element and being extendable beyond the first and third edges of the first and second outer surfaces, the overlapping area being extendable beyond the profile element when extending beyond the first edge and extendable beyond the profile element when extending beyond the third edge wherein the sealing element can cover all of both the first and second outer surfaces and can extend away from the profile element beyond the first edge and the third edge of the profile element.

25. Profile system according to claim 24, wherein the mounting area of the sealing element is fixed to both the first and second outer surfaces.

26. Profile system according to claim 24 wherein the profile element defines a channel extending along the length of the profile element and open at the ends of the body, the channel being partially surrounded by the first and second walls of the profile element.

27. Profile system according to claim 26 wherein the profile element includes a channel opening and a discharge opening;

the channel opening extending along the length of the profile element that fluidly communicates the channel with the exterior of the profile element whereby water from outside of the profile element can flow into the channel through the opening; and the discharge opening extending through one of the first wall and the second wall and fluidly communicating the channel with the exterior of the profile element.

28. Profile system according to claim 27, wherein the body of the profile element is a U-shaped member comprising a lower base wall, an upper base wall spaced from the lower base wall, and a back wall connecting the upper base wall and the lower base wall, the back wall facing the channel and the channel opening, the first wall being the back wall and the second wall being the lower base wall;

and the discharge opening is disposed in the lower base wall.

29. Profile system according to claim 28 wherein the lower base wall comprises an inner wall surface facing the channel opening and extending along the channel opening, the inner wall surface extending transverse to the length direction towards the back wall and sloping towards the outer surface of the second wall as the inner wall surface extends towards the back wall.

30. Profile system according to claim 27 wherein the overlapping area of the sealing element is attached to one or more surfaces of a sanitation installation, the sanitation installation including a drain pipe that receives water to be drained from sanitation installation, the drain pipe extending away from the discharge opening of the profile element whereby water discharged from the channel through the discharge opening is received into the drain pipe.

31. Profile system according to claim 24, wherein the first and second outer surfaces are each flat.

* * * * *